United States Patent [19]

Hall, Jr. et al.

[11] 4,116,615

[45] Sep. 26, 1978

[54] DOOR-ACTUATED ACTIVATION MEANS FOR FLASHLAMP ARTICLE

[75] Inventors: Harold H. Hall, Jr., Marblehead; Andre C. Bouchard, Peabody, both of Mass.

[73] Assignee: GTE Sylvania Incorporated, Stamford, Conn.

[21] Appl. No.: 839,652

[22] Filed: Oct. 5, 1977

[51] Int. Cl.[2] ..... G08B 3/14; G08B 7/08; G08B 13/08

[52] U.S. Cl. ..... 431/92; 431/93; 116/87; 116/7

[58] Field of Search ..... 116/5, 4, 15, 7, 105, 116/104, 101, 85, 86, 2, 87, 89, 100, 83; 362/11, 13, 14, 15; 340/276, 228; 102/86.5, 70 R; 431/95 R, 95 A, 93, 92

[56] References Cited

U.S. PATENT DOCUMENTS

| | | | |
|---|---|---|---|
| 635,595 | 10/1899 | Reiff | 116/87 |
| 680,190 | 8/1901 | Britton | 116/87 |
| 3,714,647 | 1/1973 | Litman | 340/416 |
| 3,805,257 | 4/1974 | Litman | 340/219 |

*Primary Examiner*—S. Clement Swisher
*Assistant Examiner*—Denis E. Corr
*Attorney, Agent, or Firm*—Lawrence R. Fraley

[57] ABSTRACT

Means for activating a multilamp flashlamp article in response to movement of a door. An activator having several upstanding engagement members is operatively joined to the base portion of a two-part housing. Movement of a pivoted arm portion of the housing toward the base causes a casing member to move about the activator whereby each of the engagement arms will activate a respective lamp unit within the flashlamp article. The invention is ideally suited for use within an intrusion alarm system.

12 Claims, 4 Drawing Figures

DOOR-ACTUATED ACTIVATION MEANS FOR FLASHLAMP ARTICLE

CROSS REFERENCE TO COPENDING APPLICATIONS

An application listed under U.S. Ser. No. 839,429 was filed Oct. 5, 1977 and is assigned to the assignee of the present invention. U.S. Ser. No. 839,429 is a desing application entitled "Door-Actuated Activator For Flashlamp Article".

Two additional applications listed under U.S. Ser. No. 803,564 and U.S. Ser. No. 803,565 were filed June 6, 1977 and are assigned to the assignee of the present invention. U.S. Ser. No. 803,565 entitled "Flashlamp Assembly for Providing Highly Intense Audible and Visual Signals" (A.C. Bouchard et al), defines a multi-lamp flashlamp assembly which incorporates a combustible member for each lamp. The combustibles provide highly intense audible signals in response to receipt of the radiant energy from the fired flashlamps. U.S. Ser. No. 803,564, entitled "Activating Mechanism for Flashlamp Article" (A.C. Bouchard et al), defines several embodiments for activating mechanisms which may trigger a flashlamp article similar to the one defined in U.S. Ser. No. 803,565.

Another application, listed under U.S. Ser. No. 803,563 and entitled "Activation Means for flashlamp Article" (R. G. Blaisdell et al), defines a flashlamp article activator which incorporates a biasing means therein which substantially prevents accidental firing of the flashlamp article. It was filed June 6, 1977 and is also assigned to the assignee of the instant invention.

BACKGROUND OF THE INVENTION

The invention relates to activating means and more particularly to means for activating a flashlamp article when the article is positioned thereon. The invention as defined is particularly applicable to means which are actuated by the movement of a door. Accordingly, the invention is especially suited for use in intrusion alarm systems.

It is highly desirous in many alarm systems to provide means for emitting a high energy visible signal. Such an output may successfully frighten away a prospective intruder as well as actuate a nearby audible signal generating component. In U.S. Pat. Nos. 3,805,257 (A. L. Litman et al) and 3,714,647 (A. L. Litman), and in the above-cited applications, the desired means for providing this visible output is a flashlamp article currently available on the market under the name "MAGICUBE". The lamps in these components are each mechanically activated by a prestressed striker spring associated therewith, said spring in turn being mechanically activated by some means located externally of the article. In the alarm systems of U.S. Pat. Nos. 3,805,257 and 3,714,647, the function of the intense visible signal is to actuate an electrically-operated receiving unit located nearby. In the systems defined in the above applications, the high energy light from the flashlamp article triggers a combustible member, e.g. a pyrotechnic component, located in operative relationship thereto.

A key feature of the present invention is the ability to activate a flashlamp article such as the known "MAGICUBE". Another feature of the present invention is simplicity of operation, thus substantially reducing costs of manufacture and the opportunity for mechanical breakdown.

It is believed therefore that a flashlamp article activating means possessing the advantageous features cited above would constitute an advancement in the art.

OBJECT AND SUMMARY OF THE INVENTION

It is a primary object of the present invention to provide a flashlamp activating means having the advantageous features previously defined.

This objective is accomplished in accordance with one aspect of the invention by provision of a door-actuated activation means which comprises a housing, a casing secured to a movable arm of the casing, and an activator operatively connected to a base portion of the housing. Movement of the arm toward the base results in actuation by the activator of a flashlamp unit within a flashlamp article positioned on the casing.

DETAILED DESCRIPTION OF THE PREFERRED EMBODIMENT

For a better understanding of the present invention together with other and further objects, advantages and capabilities thereof, reference is made to the following disclosure and appended claims in connection with the above described drawings.

Figure 1:
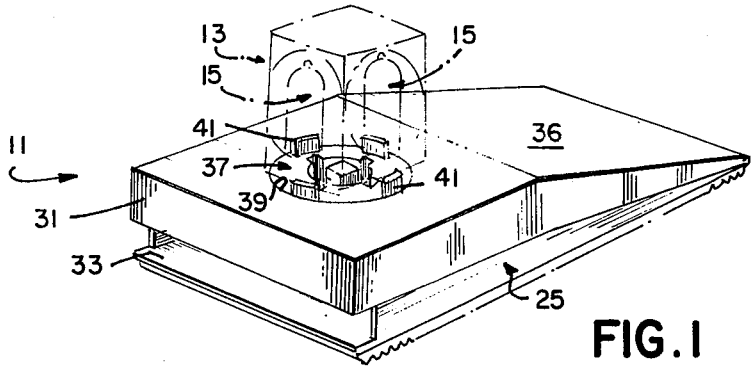
FIG. 1 is an isometric view of an activation means in accordance with a preferred embodiment of the invention.
Figure 2:
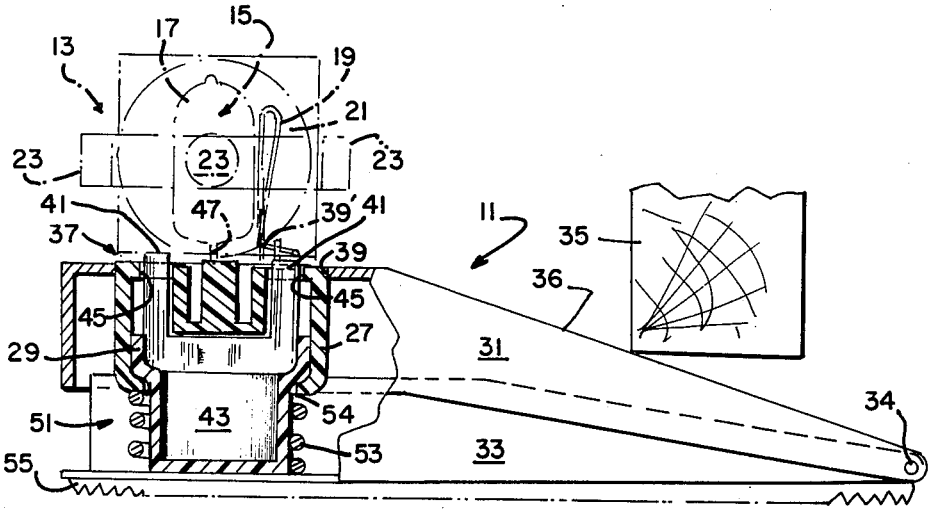
FIGS. 2 and 3 are side elevational views, partly in section, of the embodiment of FIG. 1 illustrating the movement of various components of the invention during actuation thereof.
Figure 3:
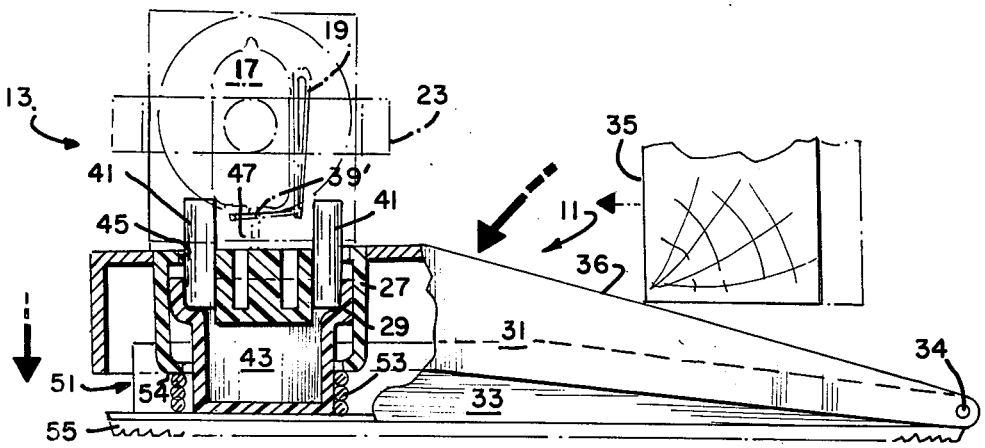

With particular reference of FIGS. 1-3, there is shown an activation means 11 for activating a flashlamp article 13 (phanton) when article 13 is positioned thereon. As defined in the aforementioned applications U.S. Ser. No. 803,564 and U.S. Ser. No. 803,565, article 13 preferably comprises a plurality, e.g. four, of individual flashlamp units 15. Each unit includes a percussively-ignitable flashlamp 17 and prestressed striker spring 19 associated therewith. A reflector 21 may be included and located adjacent each unit 15 to reflect much of the highly intense light emitted from lamp 17 away from article 13 toward a desired object. A known example of a flashlamp article similar to that described above is the "MAGICUBE" photoflash article presently available on the market, said component having a reported reliability factor exceeding 99 percent. "MAGICUBE" articles are produced and sold by the assignee of the present invention. To provide means for an audible signal, article 13 may include a plurality of combustible members in the form of pyrotechnic devices 23 located adjacent lamps 17 and capable of providing a highly intense audible signal in response to receipt of radiant energy from the lamps. The desired pyrotechnic formulations and other specifications for article 13 are provided in U.S. Ser. No. 803,565.

Activation means 11 comprises a housing 25, a casing 27, and an activator 29 located substantially within casing 27.

Housing 25 includes arm and base portions 31 and 33, respectively. Arm portion 31 is pivotally mounted on base 33 (at axis 34) and moves toward the base in response to external actuation of housing 25 by a door 35. This actuation occurs when door 35 engages an angular surface 36 of arm 31. Casing 27 is secured to arm 31 and includes a seating portion 37 adapted for having flashlamp article 13 positioned thereon. Seating portion 37 is preferably located within an opening 39 provided in first portion 31. Activator 29 includes at least one upstanding engagement member 41 for engaging and releasing one of the striker springs 19 of unit 15 to effect firing of lamp 17. When article 13 contains four lamp units 15, it is thus preferred to include four engagement members 41 on activator 29. Activator 29 further includes an end portion 43 which extends from casing 29 and is preferably secured to base portion 33 of housing 25. Casing 27 is shown in FIGS. 2 and 3 as occupying two positions about activator 29 in response to movement of arm 31. The first, shown in FIG. 2, represents the condition of activation means 11 prior to external actuation thereof by door 35. The second position, illustrated in FIG. 3, clearly shows activation of flashlamp article 13 and the resulting flash emitted therefrom.

In comparing FIGS. 2 and 3, actuation of means 11 has caused casing 27 to move from the described first position to the second whereby each of the engagement members 41 of activator 29 pass through a corresponding aperture 45 within seating portion 37 to engage and release a respective striking arm 39′ of one of the striker springs 19. Each striking arm 39′ will thus move to engage and deform the primer 47 typically associated with a percussively-ignitable flashlamp. Deformation of primer 47 causes a quantity of fulminating material therein to deflagrate up through the primer's tube and ignite a combustible material, e.g. shredded zirconium, located within the light-transmitting envelope of lamp 17.

End portion 43 of activator 29 is shown as being affixed to and thus positioned on base portion 33 of housing 25. It is understood, however, that end 43 may simply extend from casing 27 and be spaced from portion 33 an established distance to provide a delay prior to actuation of article 13. Such a delay could permit an individual familiar with means 11 to deactivate the device and prevent firing of flashlamps 17.

Means 11 further comprises a means 51 for separating portions 31 and 33 of housing 25. Means 51 is preferably a helical spring 53 located about end portion 43 of activator 29. Spring 53 rests on base portion 33 and is operatively joined to first portion 31 through casing 27. As shown in FIGS. 2 and 3, spring 53 is positioned against casing 27 at surface 54 to thus apply a force between portions 31 and 33 to effect separation thereof. Spring 53 will maintain this force continuously despite closure of housing 25 to thus assure return of portions 31 and 33 to their original positions after actuation of means 11 has been terminated. The actuating force exerted by door 35 overcomes the separating force exerted by spring 53 to permit closure of housing 25.

Base portion 33 is adapted for being positioned on a floor or similar surface adjacent door 35. Accordingly, it is preferred to provide portion 33 with a traction means, e.g. rubber tread 55 which rests on and frictionally engages this surface.

Figure 4:
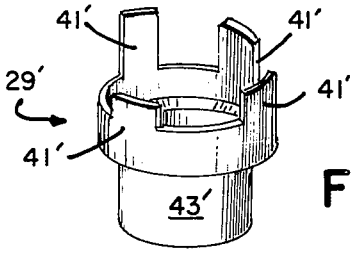
FIG. 4 is an isometric view showing an alternate emodiment of an activator for use in the invention.

In FIG. 4 is shown an activator 29′ in accordance with an alternate embodiment of the invention. Activator 29′ includes a plurality, e.g. four, of engagement members 41′ each of a different length. The engagement members 41 of actuator 29 as shown in FIGS. 1–3 are similar in length to thus cause concurrent activation of all lamps 17 in article 13. The purpose of using engagement members of different lengths is to provide an activation of article 13 of longer duration. Furthermore, the total activating force will be equally divided among the various engagement members which now act sequentially to engage striker springs 19. The remaining parts of activator 29′, e.g. end 43′ are substantially identical to corresponding parts of activator 29.

Although the present invention has been defined as fully capable of activating percussively-ignitable flashlamp articles, it is within the scope of the invention to fire electrically-activated lamp units. For example, means 11 could include a suitable power source therein, e.g. a battery, with a flashlamp article having electrically-activated lamps positioned on seating portion 37. Closure of portions 31 and 33 would thus result in a corresponding closure of a respective pair of electrical contacts to effect current flow to the article and provide activation thereof. As another example, closure of portions 31 and 33 could serve to deform a piezoelectric crystal which in turn would supply an instantaneous high voltage to a corresponding flashlamp article having corresponding lamps therein. High voltage lamps suitable for use in this embodiment are currently on the market and sold in photoflash units known as "FLIP FLASH".

While there have been shown and described what are at present considered the preferred embodiments of the invention it will be obvious to those skilled in the art that various changes and modifications may be made therein without departing from the scope of the invention as defined by the appended claims.

What is claimed is:

1. A door-actuated activation means for activating at least one flashlamp unit located within a flashlamp article, and activation means comprising:

a housing including a base portion and movable arm portion, said movable arm portion pivotally mounted on said base portion for moving toward said base portion in response to external actuation of said housing by a door;

a casing secured to said arm portion of said housing and including a seating portion for having said flashlamp article positioned thereon;

an activator located substantially within said casing in operative relationship to said base portion for effecting activation of said flashlamp unit within said flashlamp article when said article is positioned on said seating portion of said casing, said activator effecting said activation in response to movement of said arm portion of said housing toward said base portion; and means located substantially within said housing in operative relationship to said arm and base portions of said housing for applying a force between said portions to effect separation thereof.

2. The activation means according to claim 1 wherein said casing occupies first and second positions about said activator in response to movement of said arm portion toward said base portion, said activator effecting said activation of said flashlamp unit when said casing occupies said second position.

3. The activation means according to claim 1 wherein said arm portion of said housing includes an opening therein, said seating portion of said casing positioned substantially within said opening.

4. The activation means according to claim 1 wherein said activator includes at least one upstanding engagement member.

5. The activation means according to claim 4 wherein said flashlamp unit comprises a percussively-ignitable flashlamp and a prestressed striker spring associated therewith for effecting firing of said flashlamp upon release thereof, said engagement member of said activator engaging said striker spring to effect said release when said casing occupies said second position about said activator.

6. The activation means according to claim 5 wherein the number of flashlamp units is four, said activator including one of said upstanding engagement members for each of said flashlamp units.

7. The activation means according to claim 5 wherein said seating portion of said casing includes at least one aperture therein, said engagement member passing through said aperture prior to effecting release of said striker spring.

8. The activation means according to claim 6 wherein said engagement members are similar in length.

9. The activation means according to claim 6 wherein each of said engagement members is different in length.

10. The activation means according to claim 1 wherein said activator includes an end portion extending from said casing and secured to said base portion of said housing.

11. The activation means according to claim 10 wherein said means for applying a force between said arm and base portions of said housing to effect separation thereof comprises a helical spring.

12. The activation means according to claim 11 wherein said helical spring is positioned substantially about said extending end portion of said activator.

* * * * *